US009022222B2

(12) United States Patent
Devroe

(10) Patent No.: US 9,022,222 B2
(45) Date of Patent: May 5, 2015

(54) DEVICE FOR THE SELECTIVE GRANULOMETRIC SEPARATION OF SOLID POWDERY MATERIALS USING CENTRIFUGAL ACTION, AND METHOD FOR USING SUCH A DEVICE

(75) Inventor: Sebastien Devroe, Bouvines (FR)

(73) Assignee: Fives FCB, Villeneuve d'Ascq (FR)

( * ) Notice: Subject to any disclaimer, the term of this patent is extended or adjusted under 35 U.S.C. 154(b) by 935 days.

(21) Appl. No.: 13/145,886

(22) PCT Filed: Jan. 26, 2010

(86) PCT No.: PCT/FR2010/000065

§ 371 (c)(1),
(2), (4) Date: Jul. 22, 2011

(87) PCT Pub. No.: WO2010/086528

PCT Pub. Date: Aug. 5, 2010

(65) Prior Publication Data

US 2011/0281713 A1 Nov. 17, 2011

(30) Foreign Application Priority Data

Jan. 29, 2009 (FR) ..... 09/00378

(51) Int. Cl.

| | |
|---|---|
| ***B04C 5/14*** | (2006.01) |
| ***B07B 7/083*** | (2006.01) |
| ***B07B 4/04*** | (2006.01) |
| ***B07B 11/06*** | (2006.01) |

(52) U.S. Cl.

CPC . *B07B 7/083* (2013.01); *B07B 4/04* (2013.01); *B07B 11/06* (2013.01)

(58) Field of Classification Search

USPC ..... 209/20, 138, 139.1, 142, 154, 718, 720, 209/454, 456, 461, 483

See application file for complete search history.

(56) References Cited

U.S. PATENT DOCUMENTS

| | | | | |
|---|---|---|---|---|
| 3,275,140 | A * | 9/1966 | Rasmussen | 209/139.2 |
| 3,669,265 | A * | 6/1972 | Conley | 209/135 |
| 4,296,864 | A * | 10/1981 | Misaka et al. | 209/135 |
| 4,390,419 | A * | 6/1983 | Barthelmess | 209/11 |

(Continued)

FOREIGN PATENT DOCUMENTS

| | | |
|---|---|---|
| FR | 2 642 994 A1 | 8/1990 |
| FR | 2 658 096 A1 | 8/1991 |

(Continued)

*Primary Examiner* — Joseph C Rodriguez

(74) *Attorney, Agent, or Firm* — Young & Thompson

(57) ABSTRACT

A device for the selective granulometric separation of solid powdery materials using centrifugal action, capable of separating materials into a fine material fraction and a coarse material fraction, includes: a housing, a cylindrical rotor rotatable, relative to the housing, about a vertical axis inside the housing and provided with blades evenly distributed on the periphery of an upper outlet opening through which a stream of gas, laden with particles having a size lower than a predetermined particle size, is drawn, a set of vertical adjustable vanes evenly distributed about the rotor along the generatrices of a virtual cylinder and directing the gas stream towards the rotor, elements for feeding the particles between the vanes and the rotor, collecting unit lower than the rotor for collecting the unfed particles having fallen and having a size larger than the predetermined particle size. The collecting unit includes a peripheral system with a fluidized bed extending about the rotor axis, at least underneath the vanes and the gap between the vanes and the rotor.

17 Claims, 5 Drawing Sheets

(56) References Cited

U.S. PATENT DOCUMENTS

Figure 1:
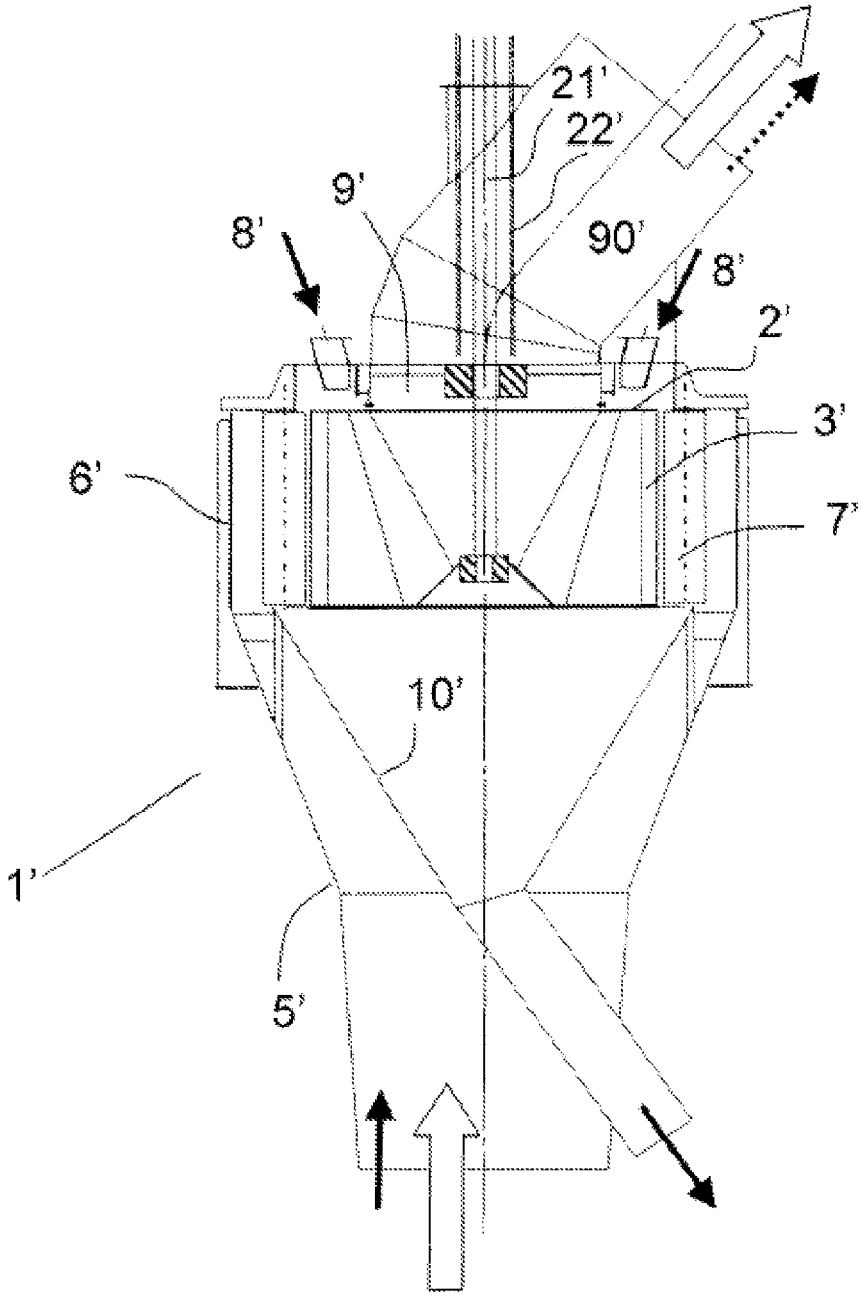
Figure 1 (Prior Art)

| | | | | |
|---|---|---|---|---|
| 4,523,990 | A | 6/1985 | Duyckinck | |
| 4,799,595 | A * | 1/1989 | Binder | 209/135 |
| 5,120,431 | A | 6/1992 | Cordonnier | |
| 5,232,096 | A * | 8/1993 | Weit | 209/135 |
| 5,511,668 | A * | 4/1996 | Keuschnigg | 209/135 |
| 5,533,629 | A * | 7/1996 | Ito et al. | 209/714 |
| 6,398,139 | B1 * | 6/2002 | Nied | 241/5 |
| 7,900,779 | B2 * | 3/2011 | Kolacz | 209/714 |
| 8,033,399 | B2 * | 10/2011 | Pistorius et al. | 209/713 |
| 8,312,994 | B2 * | 11/2012 | Schneider et al. | 209/139.1 |

FOREIGN PATENT DOCUMENTS

| | | | |
|---|---|---|---|
| GB | 943 722 | A | 12/1963 |
| JP | 60212277 | A | 10/1985 |
| JP | 1242161 | A | 9/1989 |
| JP | 4243582 | A | 8/1992 |
| JP | 5277389 | A | 10/1993 |
| JP | 7155698 | A | 6/1995 |
| JP | 2001104888 | A | 4/2001 |

* cited by examiner

DEVICE FOR THE SELECTIVE GRANULOMETRIC SEPARATION OF SOLID POWDERY MATERIALS USING CENTRIFUGAL ACTION, AND METHOD FOR USING SUCH A DEVICE

The present invention concerns a device for the selective granulometric separation of solid powdery materials, using centrifugal action, as well as a method of using such a device.

This type of device makes it possible to separate a stream of particles present in a flow of gas into two fractions, a fine one below a given granulometry, the other coarse, above said granulometry.

Such a device is also, in the corresponding industrial environment, referred to as a "centrifugal action air selector".

Separation is effected by means of a cylindrical rotor with a vertical axis, provided with blades regularly distributed over the periphery thereof, and between which the particles are subjected to opposing forces, namely firstly the centrifugal force generated by the rotation of the rotor and which tends to reject them, and secondly the drag force generated by the velocity of a gas sucked towards the centre of the rotor, and which tends to entrain them with it towards the outlet of said gas.

Thus the centrifugal force is higher for the particles with the coarsest size and the drag force higher for the particles with the smallest size, which effects the granulometric selection of the materials being treated. The materials with a size smaller than a given selection granulometry are therefore entrained with the gas towards the outlet of said gas, while the materials with a size larger than said given granulometry fall and are collected by gravity.

Such high-performance separation devices are in particular described in the documents FR 2 642 994 or FR 2 658 096.

The materials to be treated can be fed both through the top part by gravity, in which case the materials are generally dispersed by a rotation plate secured to the rotor, or as a suspension in the incoming gas, or by combining the above two supply modes.

In the known apparatus of the prior art, materials the sizes of which are greater than the given selection granulometry are collected by means of a hopper in the form of an inverted cone, situated under the rotor. The walls of the hopper must have a high slope with respect to the horizontal, generally from 50° to 60°, in order to ensure the gravity flow of the materials towards the outlet, at the vertex of the cone. This slope determines the height of the conical hopper, which constitutes a substantial part of the height of the complete apparatus. The height of this hopper cannot thus be reduced and may pose problems of integration in certain plant.

In addition, the structure and size of this lower hopper makes it necessary to provide a motor drive for the rotor at the top part of the device. For this purpose, the gas outlet is immediately followed by an elbow in order to be able to position the rotor motor above this elbow. This configuration does however make it necessary to provide the rotation shaft connecting the motor and rotor with a sufficient length to be able to pass through the elbow. Inside this elbow, the rotation shaft must be protected by a sheath, the dedicated external cladding of which must resist abrasion.

There is however known from the document GB 943722 a selector from a previous generation suitable for separating powdery material into two fractions, one with a fine granulometry and the other with a coarse granulometry, and teaching a collection of materials by means of a fluidised bed collection system, with a low slope, in order to reduce the height of the device.

Another drawback of this type of apparatus is that the separation between the grains with smaller and greater sizes is not perfect, some of the fine grains, below said given granulometry, falling with the coarser grains into the hopper.

The number of said fine grains rejected with the coarse materials is usually referred to as "bypass selection" and constitutes an imperfection. This imperfection may be the result of a group effect, the fine grains, attached to coarser grains, being rejected by the rotor, thus falling into the hopper, or even faulty supply of the powdery materials into the device.

The aim of the present invention is to overcome all or some of the aforementioned drawbacks.

More particularly, the aim of the present invention is to propose such a device, or even a method, for reducing the selection bypass, namely the amount of fine materials rejected with the coarse materials.

Another aim of the present invention can be to propose a granulometric separation device with a limited height dimension.

Another aim of the present invention can be to propose such a device wherein the rotor drive architecture is substantially simplified.

Other aims and advantages will emerge during the following description, which is given merely by way of indication and is not intended to limit it.

The invention concerns first of all a device for the selective granulometric separation of solid powdery materials, using centrifugal action, capable of separating the materials into two fractions, a fine material fraction and a coarse material fraction, comprising:

- a housing,
- a cylindrical rotor which is rotatable relative to said housing on a vertical axis, internal to said housing, provided with blades distributed over the periphery of said rotor,
- means for supplying into said housing a gaseous flow entering through said blades into said rotor,
- a set of vanes, internal to said housing and surrounding said rotor, fixed with respect to said housing and optionally orientable, disposed coaxially facing the blades so that said incoming gaseous flow passes through them,
- means for introducing the solid materials to be sorted into said housing,
- an outlet of the rotor, said outlet enabling said gas flow and the fine entrained materials to be discharged,
- collection means, below said rotor, for the coarse non-entrained materials that fell.

According to the invention, said collection means comprise a peripheral fluidised bed system, the bed of which extends around the axis of said cylindrical rotor, at least below said vanes and the gap lying between said blades and said rotor, the speed of the fluidisation gas in a horizontal section of the fluidised bed being less than 1 m/s so as to produce a further separation between the fine materials and the coarse materials in which said fine materials are returned into the gap between said vanes and said rotor.

The invention also concerns a method of using a granulometric separation device according to the invention in which a fraction of powdery material is introduced into said housing between the vanes and the rotor of the device and is divided firstly into a fine material fraction, with a particle size less than a given granulometry, entrained by said gaseous flow entering through the rotor towards the outlet, in particular the upper outlet, of the device, and secondly into a coarse fraction, with a particle size greater than said given granulometry, rejected by the rotor towards said collection means of the device, a method in which the mean velocity of fluidisation air in a horizontal section of the fluidised bed is determined so as to be less than 1 m/second and so as to minimise in the rejections the number of particles below said given granulometry.

Figure 2:
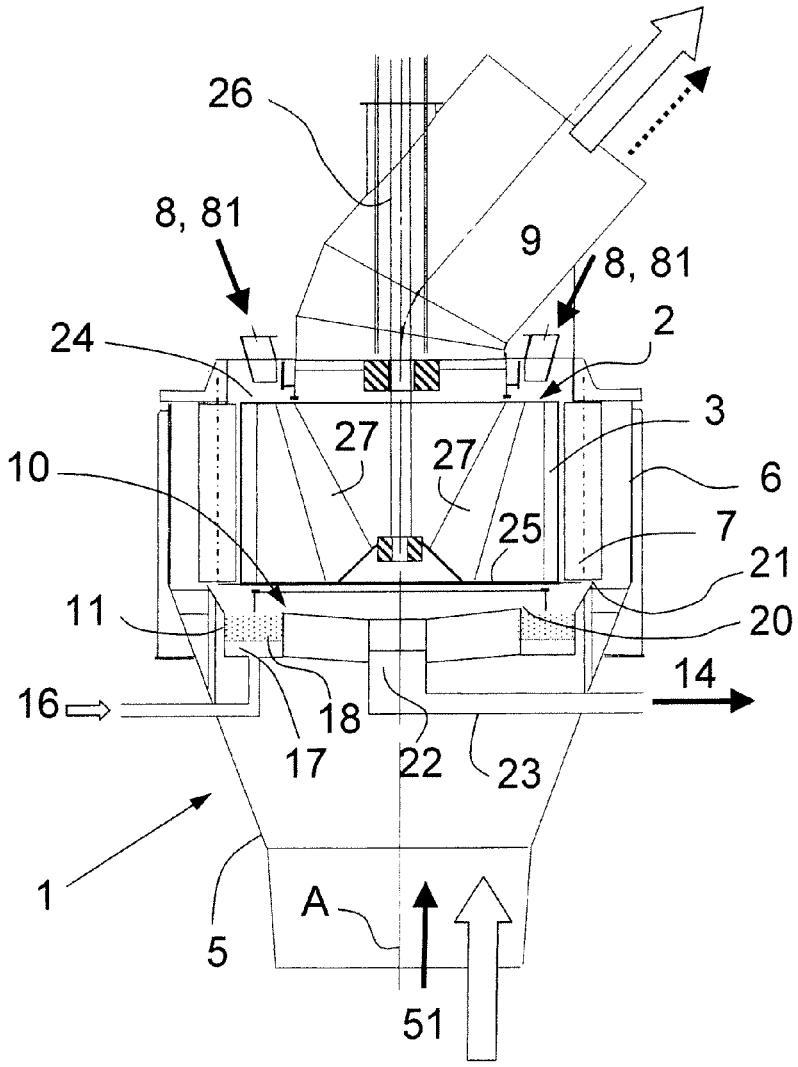
Figure 3:
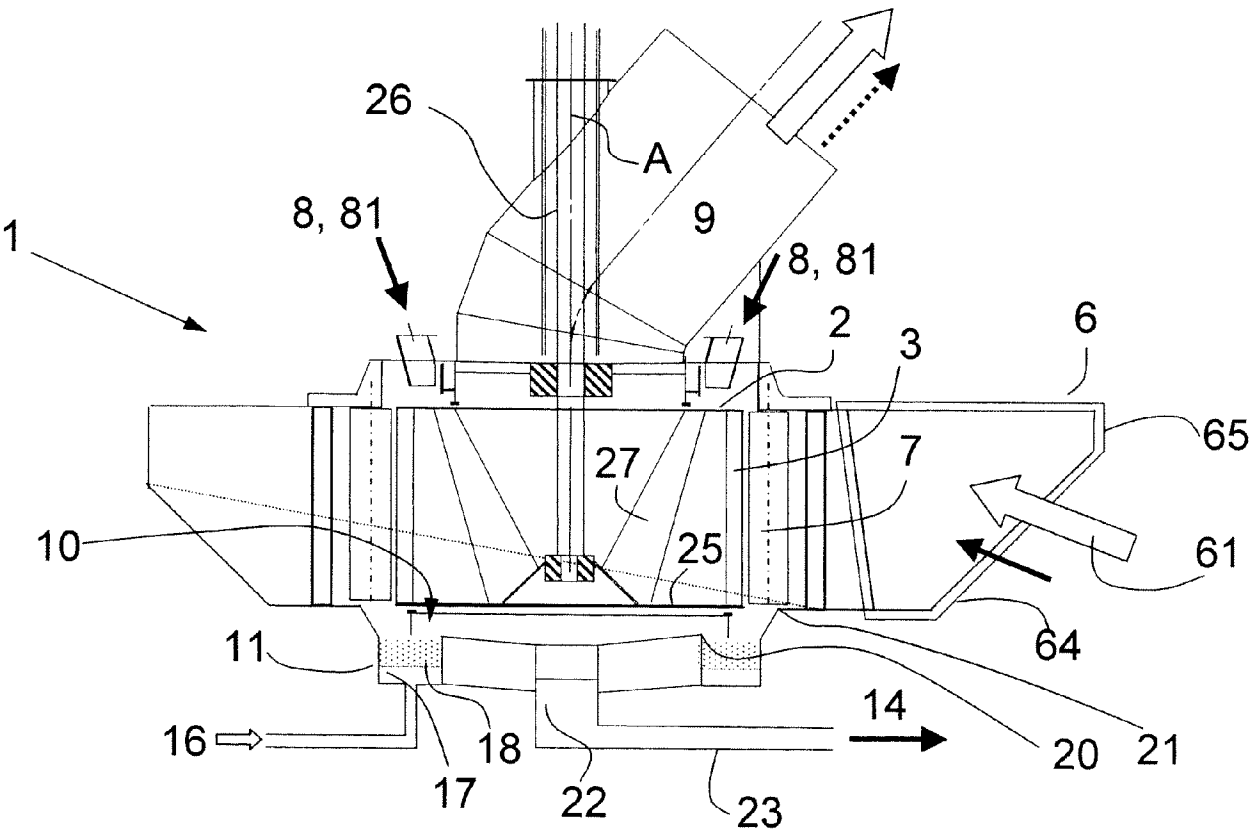
Figure 4:
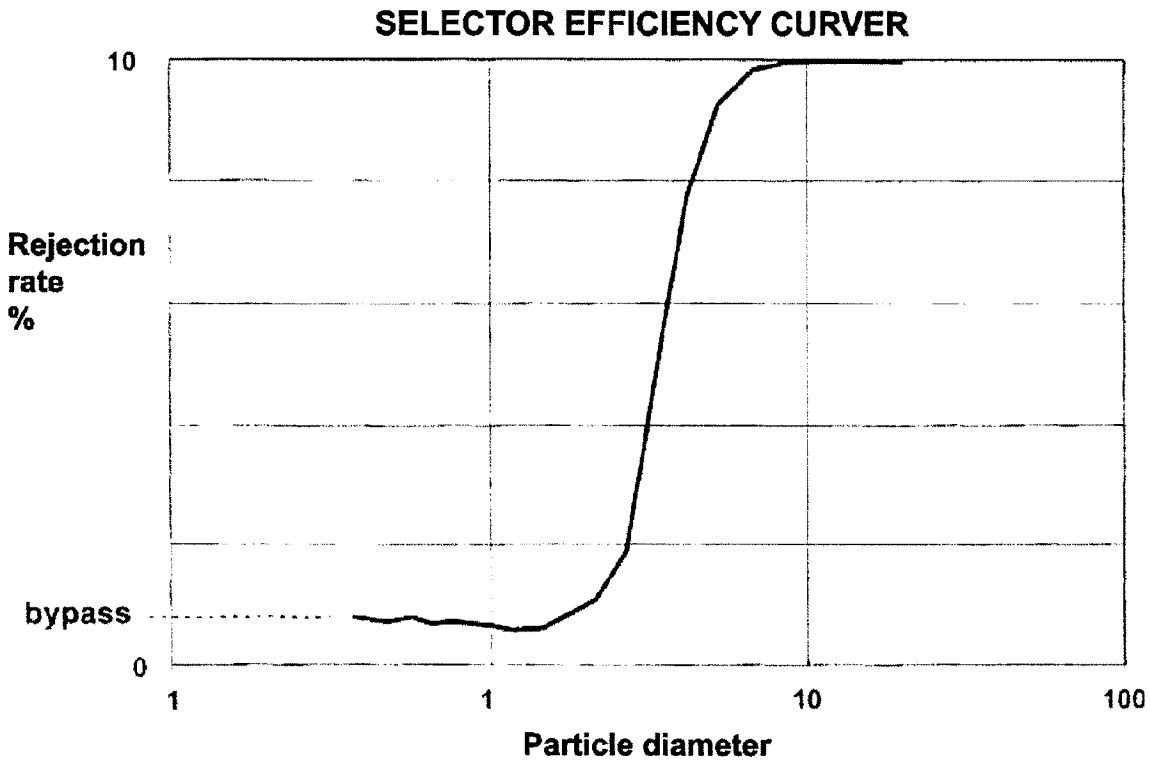
Figure 5:
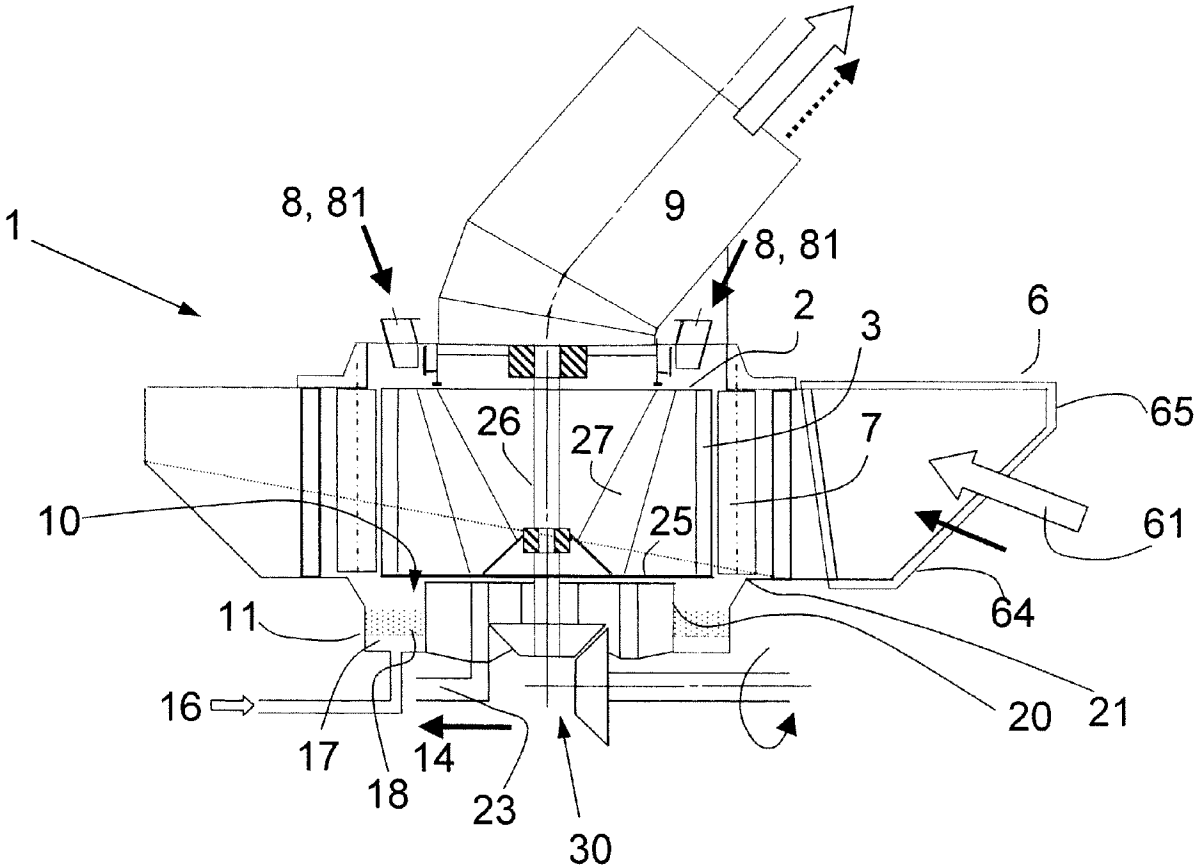

The invention will be better understood from a reading of the following description accompanied by the drawings, among which:

FIG. 1 is a schematic view of a granulometric separation device of the prior art, FIG. 2 is a view of a granulometric separation device in accordance with the invention according to one embodiment, FIG. 3 is a schematic view of a device in accordance with the invention according to a second embodiment, FIG. 4 is a graph illustrating, for a plant of the prior art according to FIG. 1, the rejection rate as a function of the particle diameter, FIG. 5 is schematic view of a device in accordance with the invention according to a third embodiment.

FIG. 1 is a diagram illustrating a separation device of the prior art.

This device 1' comprises a housing 6', inside which a rotor 2', provided with blades 3' on its periphery, can rotate on a vertical rotation axis.

A set of vanes 7' surrounds the rotor 2', opposite the blades. The vanes guide a gaseous flow in the direction of the blades 3' towards the centre of the rotor. The vanes are provided with pivots, on a vertical axis, which enable them to move so as to adjust the orientation thereof in order to adapt the velocity of the gases reaching the rotor to the rotation speed of the rotor.

The pivots of all the directing vanes are connected to the same device, making it possible to orient all the vanes at the same time at the same angle with respect to the peripheral surface of the rotor.

A hopper 10', disposed lower than the rotor and the vanes of the device, collects the materials that have fallen, rejected by the rotor, while the materials entrained by the aspirated gases are discharged through the outlet 9'.

This outlet 9' is immediately followed by an elbow 90' to enable the motor drive of the rotor to be positioned above this elbow. The rotation shaft 21', belonging conjointly to the rotor and to the motorisation thereof (not illustrated), passes through this elbow, inside which it is protected by a sheath 22'.

Gas is supplied to the device through the housing 6' and through a vertical sheath 5' extending said housing 6' downwards while enclosing the hopper 10'.

The materials to be sorted may be in suspension in the gas stream supplied, or be poured at the top part of the rotor at the introduction points 8'.

As can be seen in FIG. 1, according to the prior art, the hopper 10' has a substantial height for the device, and therefore participates in the height dimension. The hopper also makes it necessary to position the drive above the rotor 2'.

The invention concerns a device 1 for the selective granulometric separation of solid powdery materials, using centrifugal action, comprising:

- a housing 6,
- a cylindrical rotor 2, rotatable relative to said housing on a vertical axis, internal to said housing, provided with blades 3 distributed over the periphery of said rotor,
- means for supplying into said housing 6 a gaseous flow entering through said blades 3 into said rotor 2,
- a set of vanes 7, internal to said housing 6 and surrounding said rotor 2, fixed with respect to said housing and optionally orientable, disposed coaxially facing the blades so that said incoming gaseous flow passes through them,
- means for introducing the solid materials to be sorted into said housing 6,
- an outlet, in particular above said rotor 2, in particular arranged with respect to said means for supplying a gaseous stream so as to generate an ascending gas stream inside said rotor, said outlet 9 discharging said gaseous stream, in particular ascending, and fine entrained materials,
- collection means 10, lower than said rotor 2, for the coarse non-entrained materials that fell.

The vanes 7 being fixed with respect to the housing 6 means that they do not rotate with the blades 3 of the rotor. These vanes are nevertheless optionally orientable in order to adapt the speed of the gas reaching the rotor to the rotation speed of said rotor.

For this purpose, the vanes 7 can be provided with pivots on a vertical axis, the pivots of all the directing blades being connected to the same device, which makes it possible to orient all the vanes at the same time at the same angle with respect to the peripheral surface of the rotor.

According to the invention, said collection means 10 comprise a peripheral fluidised bed system, the bed of which extends around the axis A of said cylindrical rotor 2, at least below said vanes 7 and below the gap between said vanes 7 and the rotor 2.

In addition, in order to reduce the selection bypass, the speed of the fluidisation gas in a horizontal section of the fluidised bed is less than 1 m/s, in particular between 30 and 50 mm/s, so as to produce a further separation between the fine materials and coarse materials in which said fine materials are returned in the gap between said vanes 7 and said rotor 2.

As illustrated, according to the example in FIG. 2, the peripheral fluidised bed system can comprise a trough 11 forming a peripheral conveyor, the bottom of said conveyor having air blowing means 16, 17, 18.

Said trough 11, in a substantially horizontal plane, is constructed so as to constitute said fluidised bed for the granular materials thus collected.

The air-blowing means can take the form of a porous wall 18, such as a fabric, defining the bottom of said trough downstream of a plenum chamber 17 provided with a gas supply 16.

Alternatively, the air-blowing means may take the form of a plurality of nozzles, in particular metal, distributed over the bottom of said trough, in front of a plenum chamber provided with a gas supply.

The peripheral conveyor of said trough can consist of a set of straight channels, put end to end, in a polygonal configuration.

The device can have means for pouring the materials collected in said trough into one or more collectors 22. For this purpose, these means may take the form of an overflow, an underflow, tapping means, or the like.

According to an example that is not illustrated, each straight channel of the polygon may have a slight slope, the portions of the conveyor then thus constituting so many airslides. A collector can be provided at the bottom of each of said airslides in order to collect the granular materials.

According to another embodiment, as illustrated in FIG. 2, it is a case of a collector 22 internal to the peripheral corridor. According to this example, the materials are discharged from the peripheral conveyor by spill or overflow.

The collector or collectors 22 can thus be situated internal to the peripheral corridor, as illustrated in FIG. 2, positioned on the peripheral conveyor in particular at the corners of the a polygon, or provided external to the peripheral corridor.

Once the material is collected in the collector 22, it can be discharged by a handling device 23. The handling device 23 may be an airslide or a mechanical conveyor such as an Archimedes screw, a chain conveyor, a vibrating conveyor, a belt conveyor or the like.

Advantageously, the outlet 14 of the collection means 10 can be at a reduced vertical distance with respect to the position of the rotor.

The material supplied in said housing 6 can be brought with the incoming gaseous flow in the form of a suspension. Alternatively or additionally, the material supplied can be brought by gravity above the rotor and be dispersed by a rotating plate 24 secured to the rotor with respect to rotation. In all cases, the material supplied arrives in large quantities in the area between the vanes and the blades of the rotor, an area where the major part of the selection takes place.

We now describe the example of FIGS. 2 and 3.

The example in FIG. 2 comprises a cylindrically shaped rotor 2 with a vertical axis A, provided at its periphery with blades 3 regularly spaced apart. The rotor 2 has a gaseous stream loaded with particles passing through it, which enters through its lateral surface and emerges at the centre of its upper base in an axial direction towards the outlet 9. The other lower base 25 is totally closed.

The rotor 2 is moved by a motor assembly by means of a vertical shaft 26.

Through the effect of the rotation of the rotor 2, the particles are subjected to the centrifugal force that is opposed to their entry through the blades 3 while the speed of the gases imparts a drag force that entrains the particles towards the centre. The equilibrium between the two forces is such that the finest particles are entrained with the gas towards the outlet 9 while the coarse particles are rejected by the rotor and fall in order be collected by the collection means 10.

According to the invention, the collection means 10 comprise a peripheral fluidised bed system the bed of which extends around the axis A of the cylindrical rotor 2 at least below the vanes 7 and below the gap lying between said vanes 7 and the rotor 2 of the device. In doing this the bed thus covers said gap between the vanes and the blades 3 of the rotor, a gap from which the majority of the non-entrained materials fall, rejected by the rotor.

The rotor 2 is surrounded by a row of vertical vanes 7 regularly spaced apart, disposed on a virtual cylinder. These vanes are provided with pivots on a vertical axis, which enables them to move so as to adjust the orientation thereof in order to adapt the speed of the gas reaching the rotor to the rotation speed of the rotor. The pivots of all the vanes 7 are connected to the same device, which makes it possible to orient all the vanes at the same time at the same angle with respect to the peripheral surface of the rotor.

The rotor 2 is also provided with blades 27 situated between the peripheral blades 3 and the shaft 26, serving to guide, towards the outlet orifice, the streams of gas that emerge from the peripheral blades 3, thus preventing the formation of a vortex inside the rotor.

The material fed towards the rotor 2 is supplied by upper introduction points 81 and is dispersed by a plate 24. Some of the powdery materials may also be supplied with the gaseous flow 51. The dispersed materials, or those in suspension in the gaseous flow, are for the major part sorted in the gap between the vanes and the rotor.

According to this example in FIG. 2, the means of supplying a gaseous flow are formed by said housing 6 and by a vertical sheath 5 extending said housing 6 downwards. The housing/vertical sheath assembly thus encloses, from bottom to top, said collection means 10, as well as the vane 7/cylindrical rotor 2 assembly. According to this example in FIG. 2, the collection means 10 comprise a trough forming a peripheral conveyor consisting of a succession of straight channels put end to end. According to this non-limitative example, the granular materials of the fluidised bed spill over by overflow. As illustrated, the external edge 21 of said trough is at a higher level than the internal edge 20, said internal edge constituting a spill over edge for materials to a collector 22. The collector 22 discharges the material by means of a handling device 23 roughly horizontal, such as for example an airslide.

The example in FIG. 3 differs from the one in FIG. 2 through the form of the means of supplying a gaseous flow.

According to this example in FIG. 3, said means of supplying a gaseous flow are formed by said housing 6, which surrounds the vane 7/cylindrical rotor 2 assembly, with the exception of said collection means 10, which remain free to access, in particular in the case of maintenance. Said vanes 7 represent the lateral surface of a virtual cylinder coaxial with the axis A of the cylindrical rotor 2. The volume defined between the internal wall of said housing 6 and the lateral wall of said virtual cylinder forms a spiral.

The other elements of the device in FIG. 3 are identical to those in FIG. 2. The cross section of the spiral, in each radial plane intersecting the axis of the rotor, may be decreasing, in particular linearly, according to the angle at the centre having as its origin the gas supply inlet 61.

In the case of powdery material supplied as a suspension in the gaseous flow, the housing 6, forming the external wall of the spiral, may have a double inclination with an inclined lower wall section 64, in particular an angle with respect to the horizontal greater than or equal to 30°, and a vertical upper wall section 65.

The inclined lower wall 64 makes it possible, through its slope, to avoid the deposition of powdery materials and thus the formation of a layer of stagnant material in the spiral.

Advantageously, according to an embodiment illustrated in FIG. 5, the peripheral fluidised bed system may make it possible to leave a space 30 internal to said system, making it possible to motorise the rotor from the bottom with a much simpler implementation than a top motorisation.

According to this configuration, it will be noted that the height dimension may be further limited by virtue of a rotation shaft 26 of reduced length. According to this example, the various portions forming the peripheral conveyor of said trough 11 may have one or more slopes at the bottom of which one or more material collectors can be provided, as previously described.

The advantage of the invention lies in the arrangement and the operating mode of the collection means, more particularly of the fluidised bed, for the purpose of reducing bypass.

Thus, advantageously, the speed of the gas from the fluidised bed in a horizontal section may be less than 1 m/second in particular between 30 and 50 mm/s, so as to minimise the quantity of finest particles entrained with the coarse rejects.

This mean fluidisation air speed is determined so that a further sorting (new separation) occurs in which only the finest grains, with dimensions less than the given granulometry, are entrained by the air that escapes from the conveyor, and sent in the gaseous flow stream entering the gap between the blades and vanes of the device. Thus some of the finest grains that have been rejected during the first selection process by the rotor may return to the sorting zone, in front of the rotor.

If on the other hand, in this fluidisation process, grains of coarse size, with dimensions greater than the given selection granulometry, are entrained by the air flow that escapes from the conveyor, these grains will be subjected once again to the sorting process, rejected by the rotor, introducing no risk of degradation of the performance of the apparatus. Thus the invention also concerns a method of use of a device 1 for the selective granulometric separation of solid powdery materials, using centrifugal action according to the invention, in which a proportion of powdery materials is introduced into said housing 6 between the vanes and the rotor of the device and is divided firstly into a fine materials fraction, with particle sizes less than a given granulometry, entrained by said gaseous flow entering through the rotor towards the outlet, in particular upper, of the device, and secondly a coarse material fraction, with particle sizes greater than said given granulometry, rejected by the cylindrical rotor and falling into said collection means of the device.

According to the method of the invention, the mean fluidisation air speed in a horizontal section of the fluidised bed is determined at less than 1 m/s and so as to minimise, in the rejects, the number of particles smaller than said given granulometry.

Naturally other embodiments could have been implemented without for all that departing from the scope of the invention defined by the following claims.

The invention claimed is:

1. A device (1) for the selective granulometric separation of solid powdery materials, using centrifugal action, capable of separating the materials into two fractions, a fine material fraction and a coarse material fraction, comprising:

a housing (6);

a cylindrical rotor (2) which is rotatable relative to said housing on a vertical axis, internal to said housing, provided with blades (3) distributed over the periphery of said rotor (2);

means for supplying into said housing (6) a gaseous flow entering through said blades (3) into said rotor (2);

a set of vanes (7), internal to said housing (6) and surrounding said rotor (2), fixed with respect to said housing and optionally orientable, disposed coaxially facing the blades (3) so that said incoming gaseous flow passes through them;

means (8) for introducing the solid materials to be sorted into said housing (6), between the vanes (7) and said rotor (2);

an outlet (9) of the rotor (2), to enable said gas flow and the fine entrained materials to be discharged;

collection means (10), below said rotor (2), for the coarse non-entrained materials that fell, said collection means (10) comprising a peripheral fluidised bed system, the bed of which extends around the axis (A) of the rotor (2), at least below said cylindrical rotor, at least below said vanes (7) and the gap lying between said blades (7) and the rotor (2), the speed of the fluidisation gas in a horizontal section of the fluidised bed being less than 1 m/s so as to produce a further separation between the fine materials and the coarse materials in which said fine materials are returned into the gap between said vanes and said rotor, said peripheral fluidised bed system comprising a trough (11) forming a peripheral conveyor, the bottom of said conveyor having air blowing means (16, 17, 18); and a means for pouring the materials collected in said trough into one or more collectors (22).

2. The device according to claim 1, wherein the peripheral conveyor consists of a set of straight channels, put end to end, in a polygonal configuration.

3. The device according to claim 1, wherein the blowing means take the form of a porous wall (18), defining the bottom of said trough (11), downstream of a plenum chamber (17) provided with a gas supply (16).

4. The device according to claim 1, wherein a plurality of nozzles are distributed on the bottom of said trough, downstream of a plenum chamber provided with a gas supply.

5. The device according to claim 1, wherein said one or more collectors (22) discharges the material by means of a handling device (23).

6. The device according to claim 1, wherein the speed of the fluidisation gas in a horizontal section of the fluidised bed is between 30 and 50 mm/s.

7. The device according to claim 1, wherein said means of supplying a gaseous flow are formed by said housing (6) and a vertical sheath (5) extending said housing downwards, the housing/vertical sheath assembly enclosing, from bottom to top, said collection means (10) and the vane (7)/cylindrical rotor (2) assembly.

8. The device according to claim 1, wherein, said means of supplying a gaseous flow are formed by said housing (6) that surrounds the vane (7)/cylindrical rotor (2) assembly, with the exception of said collection means (10), the gas supply taking place laterally, and said vanes (7) representing the lateral surface of a virtual cylinder coaxial with the axis (A) of said cylindrical rotor, the volume defined between the internal wall of said housing (6) and the lateral surface of said virtual cylinder forms a spiral.

9. The device according to claim 8, wherein said housing (6) forming the external wall of the spiral has a double inclination with a lower wall section (64) inclined by an angle with respect to the horizontal greater than or equal to 30° and a vertical upper wall section (65).

10. The device according to claim 8, wherein rotor driving means are positioned lower than said rotor.

11. The device according to claim 1, wherein the outlet (9) is higher than the rotor (2), arranged with respect to said means for supplying a gaseous flow so as to generate an ascending gas flow inside said rotor (2).

12. The device according to claim 2, wherein the blowing means take the form of a porous wall (18) defining the bottom of said trough (11), downstream of a plenum chamber (17) provided with a gas supply (16).

13. The device according to claim 2, wherein a plurality of nozzles are distributed on the bottom of said trough, downstream of a plenum chamber provided with a gas supply.

14. The device according to claim 9, wherein rotor driving means are positioned lower than said rotor.

15. The device according to claim 3, wherein the porous wall is a fabric.

16. The device according to claim 5, wherein the handling device is selected from the group consisting of an airslide, an Archimedes screw, a chain conveyor, a vibrating conveyor, and a belt conveyor.

17. The device according to claim 12, wherein the porous wall is a fabric.

* * * * *